US007977607B2

(12) United States Patent
Colette et al.

(10) Patent No.: US 7,977,607 B2
(45) Date of Patent: Jul. 12, 2011

(54) FRAME FOR HOLDING HEATING ELEMENTS OF AN ELECTRIC HEATER OF A VENTILATING, HEATING AND/OR AIR CONDITIONING UNIT

(75) Inventors: Olivier Colette, Le Mesnil St Denis (FR); Frederic Pierron, Rambouillet (FR)

(73) Assignee: Valeo Systemes Thermiques, S.A.S., Le Mesnil St Denis Credex (FR)

( * ) Notice: Subject to any disclaimer, the term of this patent is extended or adjusted under 35 U.S.C. 154(b) by 1130 days.

(21) Appl. No.: 11/705,887

(22) Filed: Feb. 14, 2007

(65) Prior Publication Data

US 2007/0187384 A1 Aug. 16, 2007

(51) Int. Cl.
*H05B 1/00* (2006.01)
*F24D 13/00* (2006.01)

(52) U.S. Cl. ..... 219/216; 219/202; 219/504; 219/520; 219/540; 219/548; 392/347; 392/350; 392/485; 392/355; 392/365; 165/148

(58) Field of Classification Search ..... 219/202, 219/216, 504, 540, 548; 392/347, 350, 485, 392/355, 365; 165/148
See application file for complete search history.

(56) References Cited

U.S. PATENT DOCUMENTS

2005/0072774 A1 4/2005 Bohlender
2007/0000902 A1 1/2007 Brun et al.

FOREIGN PATENT DOCUMENTS

EP 1 432 287 A 6/2004
EP 1 523 225 A 4/2005
EP 1523225 * 4/2005

OTHER PUBLICATIONS

EP European Search Report for Application No. EP 07102417, dated Jun. 13, 2007, 2 pages.

* cited by examiner

*Primary Examiner* — Shawntina Fuqua
(74) *Attorney, Agent, or Firm* — Howard & Howard Attorneys PLLC

(57) ABSTRACT

A frame for receiving a heating element for an electric heater of a ventilating, heating and/or air conditioning unit of a vehicle, in particular. The frame is shaped in the form of a hollowed-out box whose large faces, intended to be traversed by airflow conveyed by the unit, are held at a distance from each other in order to create between them a space for receiving the heating element. The frame is made of a single part in which means for holding the heating element inside the space are located in the area of the large faces.

16 Claims, 2 Drawing Sheets

FRAME FOR HOLDING HEATING ELEMENTS OF AN ELECTRIC HEATER OF A VENTILATING, HEATING AND/OR AIR CONDITIONING UNIT

CROSS-REFERENCE TO RELATED APPLICATION

The instant application claims priority under 35 U.S.C. 119/365 to French Patent Application No. 0601461, filed Feb. 17, 2006.

BACKGROUND OF THE INVENTION

1. Field of the Invention

This invention relates to the field of ventilating, heating and/or air conditioning units, for a vehicle passenger compartment in particular, and specifically to the field of auxiliary electric heaters equipping such units. The object of the invention is a frame for holding heating elements that such a heater comprises.

2. Description of Related Art

Ventilating, heating and/or air conditioning units, such as those for vehicles, commonly comprise an additional electric heater. A heater such as this is intended, in particular, to produce almost immediate auxiliary heat in vehicles deficient in heat upon start-up.

Supplementary electric heaters include a frame for holding electrical components and a connector for connecting the heater to an electrical power supply of the vehicle, or even also means for monitoring and/or controlling the operation of the heater. The frame generally has an overall planar, box-like shape, which, inside of its internal hollow space, houses the heating elements, such as positive temperature coefficient (PTC) resistors.

The basic problem is posed of designing the simplest possible frame structure, in order to reduce the costs of producing and assembling the heater components.

For example, according to the publications EP 0901311 (BEHR Gmbh & Co.) and FR 2838599 (VALEO CLIMATISATION), the frame is made up of two planar frame elements assembled parallel to each other, between which the heating elements are held. In a first phase, the latter are assembled together so as to form a single unit, which is installed on one of the frame elements. The other frame element is then assembled to the preceding one in order to hold the heating element unit together. The frame constitutes not only a member for holding the heating elements together, but also an intermediate member for positioning these heating elements inside of the unit, and, in particular, inside a housing that the latter comprises. For this purpose, the frame is equipped with means for connection to at least one wall of the unit, so that the airflow circulating inside of the unit passes through its overall plane, and in particular through its two opposing large faces.

A frame design such as this results in the implementation of a significant number of parts, and a significant number of operations for assembling these parts for the heater assembly. Furthermore, such arrangements are inconsistent with the use of standard heating elements. The ways and means for manufacturing the frame should be improved so that it can be obtained at low cost, while at the same time facilitating the installation of the heating elements onto the frame and the positioning and holding of these heating elements in relation to each other and in relation to the heater connector.

OBJECT AND SUMMARY OF THE INVENTION

The purpose of this invention is to propose a frame intended to receive heating elements for an auxiliary electric heater for a ventilating, heating and/or air conditioning unit of a vehicle in particular. This invention aims more specifically to propose a frame such as this, which has a simple structure enabling it to be obtained at a low cost, while in particular limiting the assembly operations to be carried out for assembling together the heater components. This invention also aims more specifically to propose a frame such as this, which enables the use of standard heating elements, and which enables rapid and easy installation of these heating elements onto the frame, while at the same time guaranteeing their reliable positioning in relation to each other and in relation to the connector for connecting the heater to the power supply of the vehicle and/or possibly to operating controls.

The frame of the invention is a frame for receiving at least one heating element for an auxiliary electric heater for a ventilating, heating and/or air conditioning unit for a vehicle in particular. A heating element such as this is, in particular, a positive temperature coefficient (PTC) resistor, or a similar heating element. This frame is of the type that is shaped in the form of a hollowed-out box whose large faces, intended to be traversed by the airflow conveyed by the unit, are held at a distance from each other in order to create between them a space for receiving the heating element.

According to this invention, a frame of the aforesaid type is primarily recognizable in that it is made of a single part in which the means for holding the heating element inside said space are located in the area of said large faces. The holding means are, in particular, means for holding the heating element within the plane of the frame, impeding it from escaping through said large faces.

The holding means are advantageously molded integral with the frame.

According to another characteristic of the frame of the invention, a passage for inserting the heating elements into said space is made, in particular, through at least any one of the side walls of the frame. The latter being the portions of the frame that border it and that are adjacent to the large faces.

More particularly, the space for receiving the heating element is formed between the side walls of the frame. The holding means located in the area of the large faces of the frame constitute an obstacle impeding the heating element from passing both out of this space, as sought after by this invention, as well as into this space. In order to enable the heating element to be installed inside the space of the frame reserved for receiving it, despite its one-piece structure and said obstacle formed by the holding means, said passage is made in a side wall of the frame, for inserting the heating element like a drawer, by sliding between at least one or a plurality of holding members located, respectively, in the area of either of the large faces of the frame. The frame is advantageously obtained via molding, in a single manufacturing operation, and the installation of the heating element onto the frame is convenient and easy, without requiring the use of additional auxiliary mounting members resulting in additional and specific assembly operations.

The single part integrating the holding means is advantageously formed via molding of a plastic material, said large faces consisting at least in part of the holding means.

The holding means are more specifically holding means forming a stop, which are located in the plane of at least one of said large faces, advantageously both of them, in order to impede the heating element from moving towards the exterior of said receiving space.

According to a preferred embodiment, the frame comprises at least one individual channel for receiving the heating element when it is inserted into the internal space of the frame, and advantageously constitutes means for laterally positioning the heating element in relation to connecting members that a coupling connector comprises, which is intended to be added onto the frame. A plurality of channels is advantageously made, in particular by partitioning the internal space of the frame by means of longitudinal partitions that the latter comprises. More specifically, the channel is delimited at least between longitudinal partitions that run between said large faces. Such lateral positioning means for the heating element or elements make it possible to accurately position the heating element in relation to the electrical connection members of the coupling connector equipping the additional heater, in order to prevent any unwanted electrical contact. Such arrangements are, in particular, also intended to enable individual use of standard heating elements, which are installed separately from each other inside a channel allocated to them. More precisely, the channels are separated from each other by the longitudinal partitions, which advantageously constitute members for electrically insulating the heating elements from each other. Furthermore, the longitudinal partitions form stiffening ribs for the frame.

The holding means are more specifically located in the connecting area between the partitions and said large faces, while consisting, for example, of rims that the partitions comprise.

The holding members run in particular along the partitions in a continuous and/or a segmented manner. More specifically, according to a first alternative embodiment, the rims are capable of running over the entire length of the partitions. According to a second alternative embodiment, the rims run along the partitions in distant segments. For the same holding member allocated to one of the large faces of the frame, the rims are capable of being arranged on either side of the corresponding side of the partitions, or are capable of being arranged at least partially along a single edge of the side of the partitions. In this latter case, the segments can be arranged in an alternately staggered manner from one edge to the other of the same side of the partition.

According to a preferred embodiment, the holding means run in segments along the partitions. At least one segment of a holding member allocated to one of the large faces is staggered in relation to at least one segment of a holding member allocated to the other large face. These arrangements offer the advantage of easy unmolding of the frame during its manufacture, despite the fact that the configuration of the frame has been made complex.

Staggering of the segments of the holding members or elements in relation to each other is either a longitudinal and/or transverse staggering within the plane of the frame.

More precisely, segments of a first holding member or element allocated to one of the large faces of the frame are capable of being arranged at a distance from each other, on the side of a first partition. According to a first alternative, the segments of the other holding member or element are then capable of being arranged on the same partition, on its opposite side, matching up with the area remote from the segments of the first holding member. According to a second alternative embodiment, the segments of the other holding member are then capable of being arranged on another partition, on its side opposite that of the first partition, running opposite the holding member that the latter comprises.

According to one advantageous embodiment, these two alternatives can be combined. More specifically, for N segments of a holding member allocated to a first of said large faces, a holding member allocated to the other large face comprises segments that are alternately staggered longitudinally and transversely in relation to the segments of the holding member allocated to the first large face.

According to a preferred embodiment, at least one locking member for the heating element is integrated with the frame directly during molding.

The locking member advantageously cooperates with one end of the heating element in order to prohibit it from moving, at least longitudinally. For example, the locking member consists of a finger equipped with a clip, a claw, a hook or similar member, which cooperates with a complementary relief surface that the heating element comprises.

The locking member preferably runs at least within the plane of at least any one of said large faces.

According to a preferred embodiment, at least one elastic longitudinal support member for the heating element is integrated with the frame. This integration is carried out directly during molding. At least one function of this elastic member is to absorb the dimensional variations of the heating element, in the longitudinal direction in particular, both with regard to manufacturing tolerances as well as with regard to its expansion during operation.

According to a preferred alternative embodiment, at one of its ends, the heating element comprises an edge having a complementary relief surface capable of cooperating with the locking member. This relief surface, for example, consists of a shoulder made on an electrode, or of the end of a heat sink band, both forming part of the heating element. The bearing of the heating element against the elastic member as it is inserted into the interior space of the frame causes the locking member, which is advantageously mounted elastically movable within the plane of the frame, to bend until the heating element reaches a desired immobilized position on the frame.

The frame preferably incorporates transverse stiffening ribs. These transverse ribs are advantageously utilized for supporting the locking member and the elastic member. More specifically, at least one of the locking member and the elastic member is arranged on at least one of the transverse stiffening ribs that the frame comprises.

According to a preferred embodiment, a connecting member between the frame and the coupling connector for connecting the heating elements to a power supply and/or control means is integrated with the frame. This integration is advantageously carried out during molding.

The connecting member is more specifically a member for receiving the coupling connector via nesting, which is designed like a sleeve or the like, the internal hollowed-out section of which constitutes said passage for inserting the heating elements. The sleeve is more specifically equipped with at least one seat for receiving the coupling connector, and at least one relief surface for the elastic nesting of a complementary relief surface that this socket comprises. A relief surface such as this, for example, consists of a seat for receiving a clip or similar member that the coupling connector comprises.

The elastic member and the nesting member are in particular provided at two opposite sides of the frame.

According to a preferred embodiment, means for fastening the frame to at least one wall of the unit are integrated with the frame. This integration is advantageously carried out during molding. The wall of the unit is, in particular, that of a housing intended to receive the additional heater. The fastening means include, in particular, a member for guiding and positioning the frame on the wall of the unit. This guide member, for example, consists of a hook or an axially open sleeve, such as a C-shaped profile or the like, or else of a suspension or interlocking member of any shape. A suspension member such as this is capable of cooperating with a fastening rail that the unit comprises. The participating guide member of the fastening means is preferably arranged at the end of the frame opposite the one comprising the member for receiving the coupling connector via nesting, whereby the frame is held inside the unit while being engaged at its ends, respectively, with the rail and with the coupling connector, which is itself fastened onto a wall of the unit.

According to a preferred embodiment, at least at one of its ends, the frame incorporates at least one ventilation inlet for the airflow conveyed by the unit to pass through. These arrangements aim to limit air pressure losses inside the unit and to prevent the circulation of the airflow from being disrupted.

A frame of the invention, according to a preferably optimized embodiment, will be recognized in that it incorporates means for individually integrating a plurality of heating elements. These integration means are advantageously incorporated into the frame during molding. More specifically, for each of the heating elements, these integration means combine:

a) means for holding the heating elements within the plane of the frame, inside the space reserved for receiving them. These holding means consist, in particular, of said holding members consisting at least partially of said large faces.

b) longitudinal locking means for said heating elements associated with elastic support means for the heating elements at one of their ends. More specifically, the longitudinal locking means combine the clawed fingers and the elastic member.

c) means for positioning the heating elements laterally on the frame and for holding these elements in this position in relation to respective electrical connection elements that a coupling connector equipping the heater comprises. These lateral positioning means consist, in particular, of the channels for individually receiving the heating elements, which are formed between two adjacent longitudinal partitions, respectively.

The structural design of the frame enables it to be obtained at low cost, from a single molding operating using, for example, a double cavity mold and a slot for forming the sleeve intended for receiving the coupling connector and for allowing passage of the heating element or elements into the interior space of the frame. During manufacture, and without any additional assembly operation, a frame such as this incorporates all of the means required for positioning and holding the heating element at least on the frame, for positioning and holding the frame on at least one wall of the unit, and for connecting the heating element at least to the power supply of the vehicle and/or to control means, by means of the coupling connector that can be easily connected to the frame by means of the sleeve. It will be understood that the heating element can consist of a plurality of basic heating elements assembled together as a unit prior to being installed on the frame. However, the use of a plurality of basic heating elements individually installed in the channels that are allocated to them makes it possible to reduce the costs of obtaining the heater, owing to the direct use of standard heating elements and to their easy and individual installation on the frame, by sliding in a drawer-like manner into the interior space thereof, through one of its lateral faces.

It will be further noted that the drawer-like design makes it possible to customize the heating power required for various types of heaters while at the same time standardizing the main part of this heater, i.e., the frame. As a matter of fact, each element delivers on average 300 Watts, with the result being that, by using the same frame comprising four channels, for example, it is possible to create four heaters having different levels of power: 300, 600, 900 or 1200 Watts.

This invention also deals with an electric heating radiator for a heating, ventilating and/or air conditioning unit, comprising a previously described frame.

This invention also relates to a ventilating, heating and/or air conditioning unit including an auxiliary electric heater as described above.

This invention also deals with a method for assembling a previously described electric heater. This method, in particular, includes at least the steps consisting in:

a) inserting at least one heating element into the interior space of the frame, through a passage made in one side wall of the frame.

b) sliding the heating element between holding means of the frame located in the area of said large faces of the latter.

c) causing the heating element to bear against the elastic member and locking it in position via cooperation between the relief surface of the heating element and the locking member.

d) installing a coupling connector on the frame via nesting, and connecting the heating element to this coupling connector. This connection is capable of being made by nesting the heating element together with the coupling connector after it has been installed on the frame, and/or by welding the heating element to the corresponding connecting members of the coupling connector.

The method of the invention also consists in preferably individually installing a plurality of separate heating elements inside the respective channels that the frame comprises. This installation is capable of being carried out by successively putting the heating elements into place inside the interior space of the frame, or by collectively putting these heating elements into place using the same operation for individually assembling the heating elements onto the frame.

BRIEF DESCRIPTION OF THE DRAWINGS

This invention will be better understood, and details relating to it will become apparent, upon reading the description of a preferred embodiment of it, which will be made in relation to the figures of the appended drawings, in which.

DETAILED DESCRIPTION OF EXEMPLARY EMBODIMENT(S)

Figure 1:
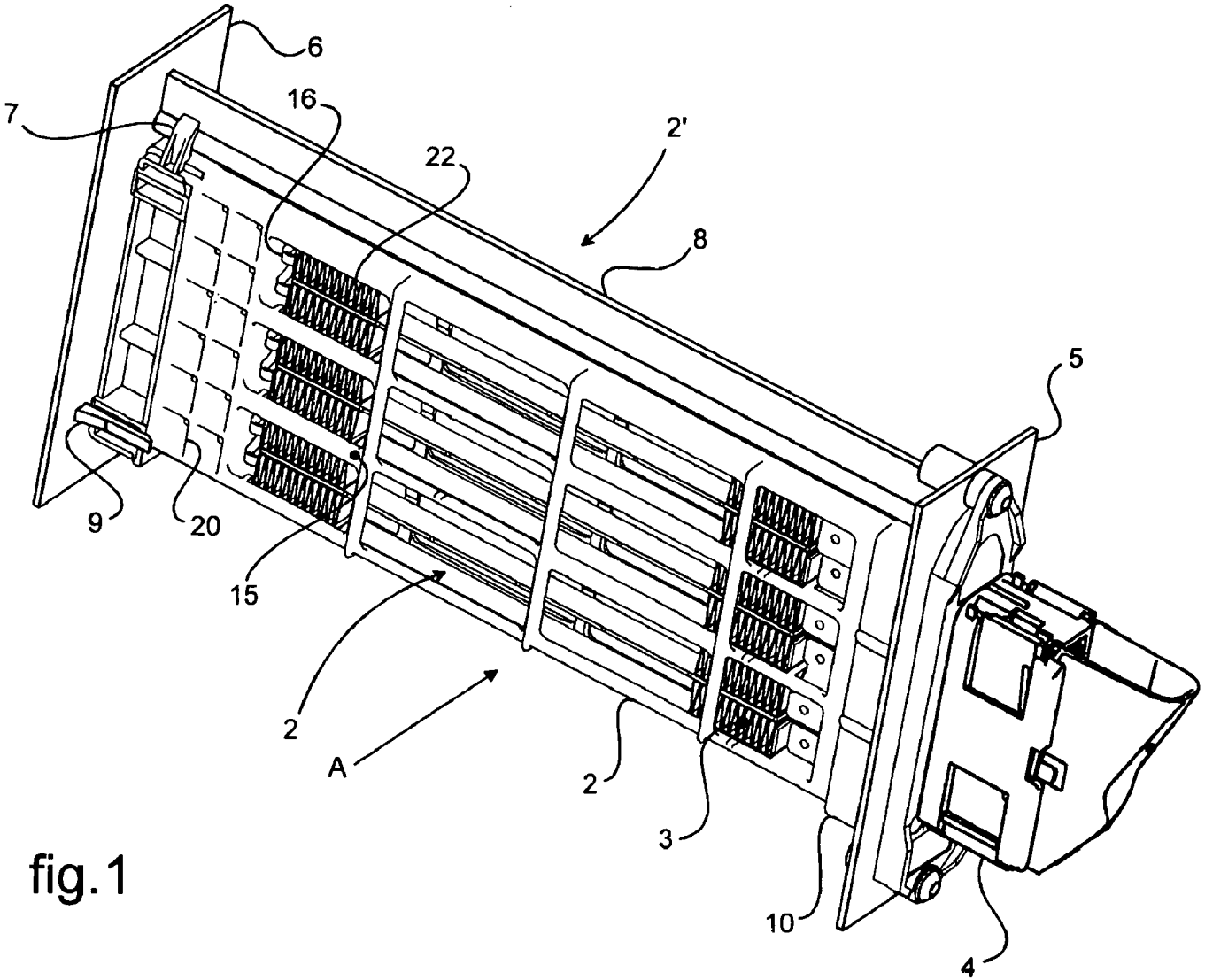
FIG. 1 is a perspective view of an additional electric heater including a frame of this invention, installed on a wall of a ventilating, heating and/or air conditioning unit.
Figure 2:
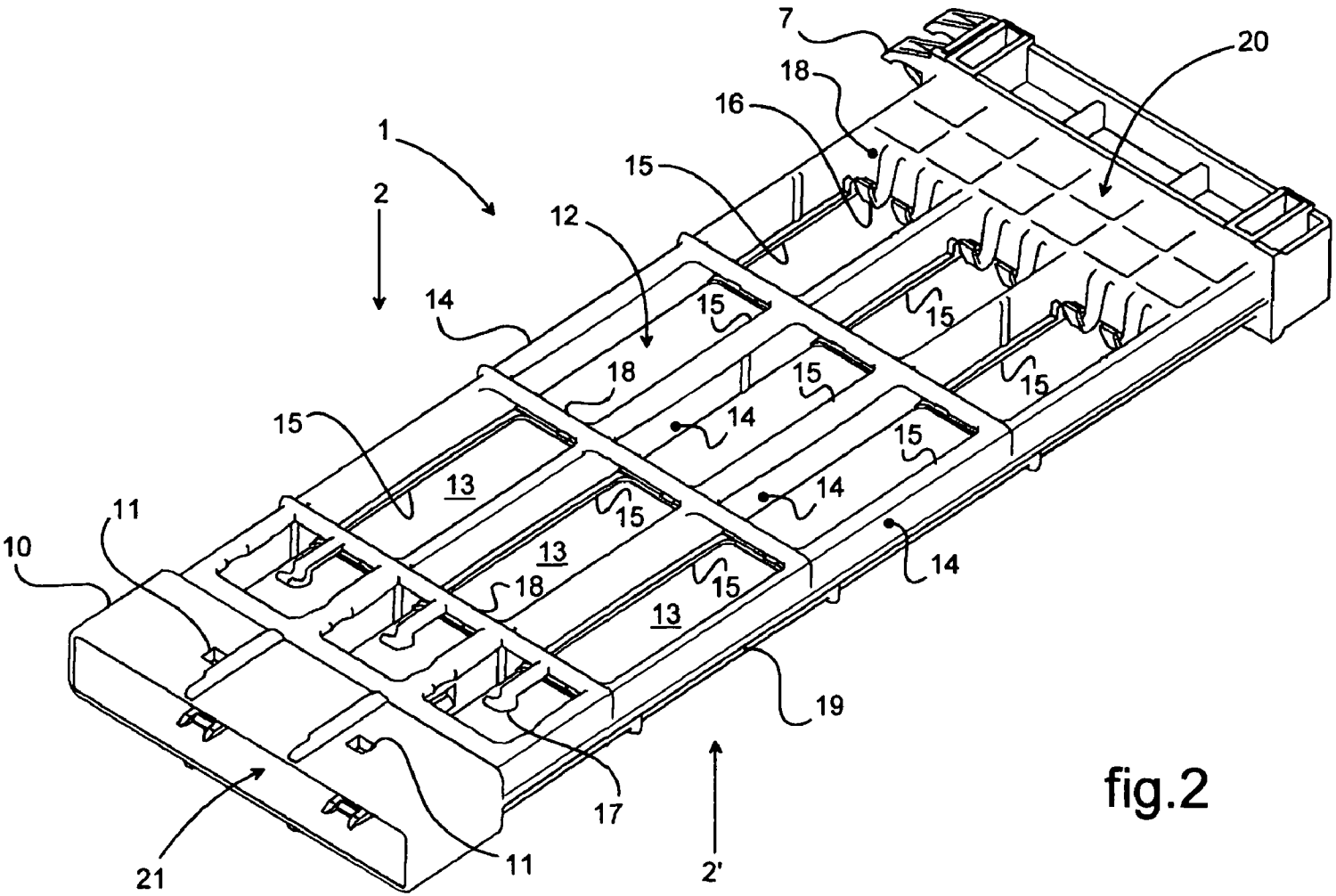
FIG. 2 is a perspective view of a frame as shown in FIG. 1.

In the figures, an electric heater is intended to equip a ventilating, heating and/or air conditioning unit of a vehicle in particular. This heater is an auxiliary heater for producing heat almost immediately in vehicles deficient in heat upon start-up.

The heater includes a planar, box-shaped frame 1, which is intended to be placed in the airflow A conveyed by the unit. This frame 1 comprises two large faces 2 and 2' intended to be traversed by the airflow, which are arranged in parallel and at a distance from each other in order to create between them an internal space 12 for receiving a plurality of heating elements 3. In the example embodiment shown, these heating elements 3 consist of positive temperature coefficient (PTC) resistors.

The frame 1 consists of a one-piece element formed via molding of a plastic material, such as polypropylene, polyamide or a similar plastic material. More specifically, the two large faces 2, 2' are arranged at a distance from each other by means of the side walls of the box forming the frame 1, these side walls consisting of a single part. In order to hold the heating elements inside the internal space 12 of the frame 1, holding members 15 molded integral with the frame are arranged, respectively, within the plane of each of the large faces 2, 2' of the frame 1. These holding members 15 form obstacles prohibiting the heating elements 3 from escaping through the large faces 2, 2' of the frame 1.

A coupling connector 4 is added onto the frame 1 for electrically coupling the heating elements 3 with an electric power supply of the vehicle and/or control means. The coupling connector 4 is added onto the frame 1 by means of a lateral sleeve 10 arranged on the frame 1, which receives this coupling connector 4 via nesting. Seats 11 are made in the sleeve 10, for receiving clips that the coupling connector 4 comprises, so as to lock the nested connection between the coupling connector 4 and the frame 1.

The internal hollowed-out space of the sleeve 10 is utilized to form a drawer-like passage for inserting the heating elements 3 into the internal space 12 of the frame 1, due to the obstacle formed by the holding members 15 impeding insertion of the heating elements via the large faces 2, 2' of the frame 1.

The coupling connector 4 is fastened onto a wall element of the unit, and in particular onto a wall element of a housing containing at least the additional heater. Since this coupling connector 4 is nested on the frame 1, the latter is held on the wall 5 of the unit. The frame 1 is further supported by a rail 8, which runs between the first wall element 5 and an opposing wall element 6 of the unit. This support is obtained by means of an interlocking member 7 arranged at the end of the frame 1 opposite the one receiving the coupling connector 4. This interlocking member 7, for example, is shaped like an open sleeve, a hook or a similar member. In addition, at least one of the wall elements 5, 6 comprises a catch 9 for holding the frame 1 in position within its overall plane. The means for fastening the frame 1 onto the unit, which, in particular, combine the sleeve 10 and the interlocking member 7, are molded integral with the frame 1.

Means for integrating the heating elements 3 into the internal space 12 of the frame 1 are incorporated into it during molding. These integration means include channels 13 for receiving the heating elements 3 individually. The latter are individually inserted by sliding into a channel 13 that is allocated to them. The channels 13 are delimited by longitudinal partitions 14, which are incorporated into the frame 1 during molding. These partitions 14 constitute not only guide members for the heating elements 3 when they are inserted into the frame 1, but also stiffening members for the frame 1, and electrical insulating members between two adjacent heating elements 3.

The holding members 15 consist of rims arranged so as to partially cover the large faces 2, 2' of the frame 1. These rims are arranged along the sides of the longitudinal partition 14 and/or along the lateral sides of the frame 1. These holding members 15 are also incorporated into the frame 1 during molding, and hold the heating elements 3 inside the internal space 12 of the frame to prevent them from escaping through the large faces of the frame 1. These holding members run in distant segments along the sides of the partitions 14. The segments of one holding member 15 of a large face 2, 2' are arranged on a first side of at least one partition 14, while the segments of a holding member 15 of the other large face 2, 2' are arranged on the opposite side of this partition 14. In the example embodiment shown, there are four partitions 14. Each of them comprises holding members 15 arranged on each of its sides. These holding members 15 are segmented, the segments arranged on one of the sides of the partition 14 being staggered longitudinally in relation to segments arranged on the other side of this partition 14. One of the holding members 15 arranged on a first side of a partition 14 is divided into two segments, the other holding member arranged on the other side of the partition 14 comprising a single segment staggered longitudinally in relation to the segments arranged on the first side of the partition 14. These arrangements make it possible to facilitate the molding and unmolding operation of the frame 1, despite its one-piece design integrating the holding members 15.

The integration means also include elastic members 16 pushing the heating elements 3 longitudinally in the direction of the sleeve 10. In the example embodiment shown, these elastic members 16 consist of tabs or a similar deformable member that are incorporated into the frame during molding. These elastic members 16 make it possible to compensate for possible dimensional variations in the heating elements 3, variations that are likely to result from the manufacturing tolerances of the heating elements 3 and/or from their expansion during operation.

The integration means also include members for locking 17 the heating elements 3 inside the channel 13 that receives them. These locking members 17 are in particular intended for positioning the heating elements 3 inside the channels 13, in a position suitable for their electrical connection to the coupling connector 4. These locking members 17 themselves are also incorporated into the frame 1 during molding, while being arranged within the plane of at least one of the large faces 2, 2' of the frame 1. In the example embodiment shown, these locking members 17 consist of clawed or hook-like fingers, which are mounted elastically movable within the plane of the frame 1 while naturally running within the plane of the large faces 2, 2'. The locking members 17 are intended to engage with a complementary relief surface 22 that the heating elements 3 comprise. In particular, there are a plurality of such complementary relief surfaces 22 for each of the heating elements 3, while being arranged in relation to each other like rack teeth.

To install the heating element 3 onto the frame 1, it is inserted through the passage 21 like a drawer, until it comes to bear against the elastic member 16 and the locking member engages with one of the complementary relief surfaces 22 of the heating element 3. The heating element 3 is guided by the holding members 15 during its insertion into the corresponding channel 13, on the one hand laterally, between the partitions 14, and, on the other hand, within the plane of the frame, between the large faces 2, 2'.

Transverse stiffening ribs 18 are also incorporated into the frame 1 during molding, which are utilized for supporting the elastic members 16 and the locking members 17. In addition, other longitudinal stiffening ribs 19 are arranged along the outer periphery of the side walls of the frame 1.

Inlets 20 for the passage of the airflow conveyed by the unit are also incorporated into the frame 1 during molding, with a view to reducing air pressure losses and so as to not disrupt the airflow circulation inside the unit. These inlets 20 are, in particular, made through a transverse stiffening end element of the frame 1.

The invention claimed is:

1. A frame for receiving at least one heating element for an electric heater of a ventilating, heating and/or air conditioning unit, this frame being shaped in the form of a hollowed-out box whose large faces, intended to be traversed by airflow conveyed by the unit, are held at a distance from each other in order to create between them a space for receiving the heating element, wherein the frame is made of a single part in which means for holding the heating element inside said space are located in the area of said large faces, and characterized in that the holding means comprises at least one holding member forming a stop, which is arranged within the plane of at least one of said large faces, movement of a heating element received in said space towards the exterior of said space impeded by the holding member.

2. A frame for receiving at least one heating element for an electric heater of a ventilating, heating and/or air conditioning unit, this frame being shaped in the form of a hollowed-out box whose large faces, intended to be traversed by airflow conveyed by the unit, are held at a distance from each other in order to create between them a space for receiving the heating element, wherein the frame is made of a single part in which means for holding the heating element inside said space are located in the area of said large faces, and characterized in that it comprises at least one channel, arranged inside said space, for individually receiving a heating element, this channel being delimited by longitudinal partitions which run in-between said large faces.

3. The frame of claim 2, characterized in that the holding means comprises at least one holding member forming a stop, which is arranged within the plane of at least one of said large faces, movement of a heating element received in said space towards the exterior of said space impeded by the holding member, and in that the holding member is arranged in the connecting area between the partition and said large face.

4. The frame of claim 3, characterized in that the holding member includes a rim that at least one partition comprises.

5. The frame of claim 3, characterized in that the holding members run along the partitions in a continuous and/or segmented manner.

6. The frame of claim 5, characterized in that the holding members run in segments along the partitions, at least one segment of a holding member allocated to one of the large faces is staggered in relation to at least one segment of a holding member allocated to the other large face.

7. A frame for receiving at least one heating element for an electric heater of a ventilating, heating and/or air conditioning unit, this frame being shaped in the form of a hollowed-out box whose large faces, intended to be traversed by airflow conveyed by the unit, are held at a distance from each other in order to create between them a space for receiving the heating element, wherein the frame is made of a single part in which means for holding the heating element inside said space are located in the area of said large faces, and characterized in that at least one locking member adapted to engage a heating element received in said space is integrated with the frame.

8. The frame of claim 7, characterized in that the locking member is adapted to cooperate with one end of a heating element received inside said space, relative movement between a received heating element and the frame being prevented at least longitudinally by the locking member.

9. The frame of claim 7, characterized in that the locking member includes a clawed finger adapted to cooperate with a complementary relief surface that the heating element comprises.

10. The frame of claim 7, characterized in that the locking member runs within the plane of at least any one of said large faces.

11. A frame for receiving at least one heating element for an electric heater of a ventilating, heating and/or air conditioning unit, this frame being shaped in the form of a hollowed-out box whose large faces, intended to be traversed by airflow conveyed by the unit, are held at a distance from each other in order to create between them a space for receiving the heating element, wherein the frame is made of a single part in which means for holding the heating element inside said space are located in the area of said large faces, and characterized in that at least one elastic longitudinal support member adapted to engage a heating element received inside said space is integrated with the frame.

12. A frame for receiving at least one heating element for an electric heater of a ventilating, heating and/or air conditioning unit, this frame being shaped in the form of a hollowed-out box whose large faces, intended to be traversed by airflow conveyed by the unit, are held at a distance from each other in order to create between them a space for receiving the heating element, wherein the frame is made of a single part in which means for holding the heating element inside said space are located in the area of said large faces, and characterized in that it incorporates means for individually integrating a plurality of heating elements.

13. The frame of claim 12, characterized in that, for each of the heating elements, the integration means combine:

a) at least one means for holding the heating element within the plane of the frame, inside the space reserved for receiving it, b) at least one longitudinal locking means for said heating element associated with at least one elastic support means for the heating element at one of its ends, and c) at least one means for positioning the heating element laterally on the frame and for holding this element in this position in relation to respective electrical connection elements that a coupling connector equipping the heater comprises.

14. An electric heater for a heating, ventilating and/or air conditioning unit, characterized in that it includes a frame for receiving at least one heating element for an electric heater of a ventilating, heating and/or air conditioning unit, this frame being shaped in the form of a hollowed-out box whose large faces, intended to be traversed by airflow conveyed by the unit, are held at a distance from each other in order to create between them a space for receiving the heating element, wherein the frame is made of a single part in which means for holding the heating element inside said space are located in the area of said large faces.

15. A ventilating, heating and/or air conditioning unit integrating an electric heater as claimed in claim 14.

16. A method for assembling an electric heater, characterized in that it includes at least the steps of:

a) inserting at least one heating element into an interior space for receiving a heating element, through a passage in one side wall of a frame, b) sliding the heating element between means for holding the heating element inside the receiving space of the frame, which are located in the area of said large faces of the latter, c) bringing the heating element to bear against an elastic member and locking it in position via cooperation between a relief surface of the heating element and a locking member of the frame, d) installing a coupling connector on the frame via nesting, and connecting the heating element to this coupling connector.

* * * * *

UNITED STATES PATENT AND TRADEMARK OFFICE

CERTIFICATE OF CORRECTION

PATENT NO. : 7,977,607 B2
APPLICATION NO. : 11/705887
DATED : July 12, 2011
INVENTOR(S) : Olivier Colette et al.

It is certified that error appears in the above-identified patent and that said Letters Patent is hereby corrected as shown below:

ON THE FACE OF PATENT:

Cover Page, add item (30) Foreign Application Priority Data
February 14, 2006 (FR) 0601461

Signed and Sealed this
Fourteenth Day of February, 2012

David J. Kappos
*Director of the United States Patent and Trademark Office*